United States Patent [19]

Dumaine et al.

[11] 4,377,261

[45] Mar. 22, 1983

[54] GRANULATOR AND IMPROVED FEED MEANS THEREFOR

[75] Inventors: Thomas J. Dumaine, North Attleboro; Joseph A. Danko, Bellingham, both of Mass.; Donald R. Poland, East Greenwich, R.I.

[73] Assignee: Leesona Corporation, Warwick, R.I.

[21] Appl. No.: 236,894

[22] Filed: Feb. 23, 1981

[51] Int. Cl.[3] ..... B02C 18/22

[52] U.S. Cl. ..... 241/222; 241/285 R

[58] Field of Search ..... 100/169; 241/73, 222, 241/224, 225, 245, 248, 98, 186.4, 280, 32, 37, 232, 230, 231, 233, 234

[56] References Cited

U.S. PATENT DOCUMENTS 4,015,782 4/1977 Granite ..... 241/222 X 4,196,861 4/1980 Bass et al. ..... 241/222 X 4,294,414 10/1981 Gerstenberg ..... 241/222

FOREIGN PATENT DOCUMENTS 698859 10/1953 United Kingdom ..... 241/222

*Primary Examiner*—Mark Rosenbaum

*Attorney, Agent, or Firm*—Robert J. Doherty

[57] ABSTRACT

A granulator primarily intended for the granulation of plastic scrap material in which a pair of meshed paddle rolls serve as a combination metering and feed device through which such plastic material is fed to the granulator. The paddle rolls are mounted in such a manner and driven by drive means which enable one of the paddle rolls to move laterally away from the other paddle roll including an angular or skewed relationship yet while still maintaining an articulated; that is, synchronized, movement of the paddle rolls in relationship to each other.

8 Claims, 8 Drawing Figures

GRANULATOR AND IMPROVED FEED MEANS THEREFOR

BACKGROUND AND SUMMARY OF THE INVENTION

This invention relates to a device for the granulation of plastic material and particularly to the granulation of plastic scrap incident in the formation of injected molded plastic parts. More particularly, the invention is directed to a unique feed device wherein plastic scrap may be fed to the granulation chamber of the granulator in an even and consistent fashion and in such a manner as to minimize granulate fly-back through the feed device from the granulation chamber.

Devices of this general nature are known, and one particularly desirable commercial device incorporating such features is the 24T Auger Granulator produced and marketed by Cumberland Engineering Company, P. O. Box 6065, Providence, Rhode Island 02940. Such device includes a granulator adapted for dispostion essentially within the confines of an injection molding machine in the drop out area thereof. As such, plastic scrap, i.e., sprues and runners, fall directly by gravity into a pair of paddle rolls which act as a combination feed and metering means for the granulator whereby scrap is fed to the granulation chamber. Thereafter, the granulated scrap moves into a secondary chamber beneath the granulation chamber and in which an auger serves to continually move the granulate to that end of the granulator disposed generally at the entrance side of the injection molding machine drop out area. It has been found that this and other machines which utilize paddle rolls, wheels, or some similar arrangement in which to provide feed of material to another operative process are susceptible to jamming should material parts of a widely differing size be fed thereto. Such jamming, or at least interference of the normal functioning of the feed rolls because of the attempted acceptance of larger than normal material parts, may also force the paddle rolls out of synchronous movement. It, accordingly, would be useful to avoid these drawbacks and yet still be able to utilize the desirable features of paddle roll-type feeds as above discussed.

It is accordingly the primary object of the present invention to provide an improved feed means construction which enables parts of various sizes to be easily accepted without danger of either jamming or forcing opposed paddle roll components thereof out of synchronous movement with each other.

A further object of the present invention is the provision of the means by which one of the paddle roll components of the feed means may be temporarily laterally displaced with respect to the other of such paddle roll components to accomodate passage of a wide size variance of parts.

A still further object of the present invention is the provision of a unique drive means whereby the shafts of such paddle roll components are driven from one end thereof in such a manner so as to accomplish such synchronous movement yet still afford the flexible lateral movement of one shaft with respect to the other.

These and other objects of the present invention are accomplished by a granulation device having a housing in part definining a generally enclosed chamber, an elongated rotor mounted for rotation about an elongated axis within said chamber, cutting means provided on said rotor for cooperative cutting relationship with bed knife means mounted for projection into said chamber as said rotor is driven, elongated feed means positioned above and generally aligned with said rotor and at least partially enclosing said chamber at the upper end thereof and removal means positioned below said chamber for removing granulated scrap from said granulator, said feed means including a pair of elongated paddle rolls each having spaced blades radially extending from a central shaft, said blades adapted to interdigitate with each other as said shafts rotate in opposite directions towards each other so as to feed material into said chamber, said shafts supported by said housing and normally disposed parallel to each other within a generally laterally disposed plane disposed above said rotor with a first of said shafts fixed in position relative to said housing and the second shaft slidably supported in said housing for movement of any portion of said second shaft along the extent thereof towards and away from said first shaft within said lateral plane so as to accomplish increased spacing between said paddles at any location therealong including locations which will skew said second shaft with respect to said first shaft so as to afford the passage of oversized material therebetween, and drive means for driving said shafts in rotational synchronism at all times despite the relative lateral movement which may take place between said shafts.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
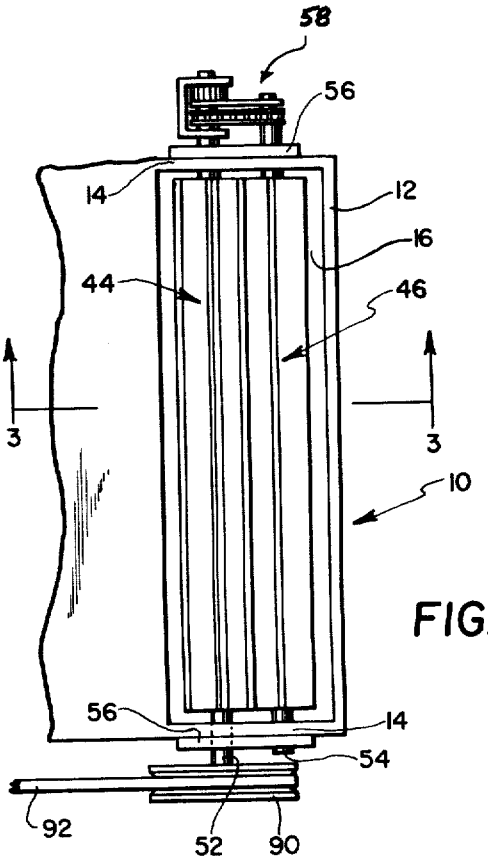
FIG. 1 is a top partial plan view of the granulation apparatus of the present invention and particularly shows the manner in which the opposed paddle rolls of the feed device thereof are disposed in relationship to the remaining portions of the device.
Figure 3:
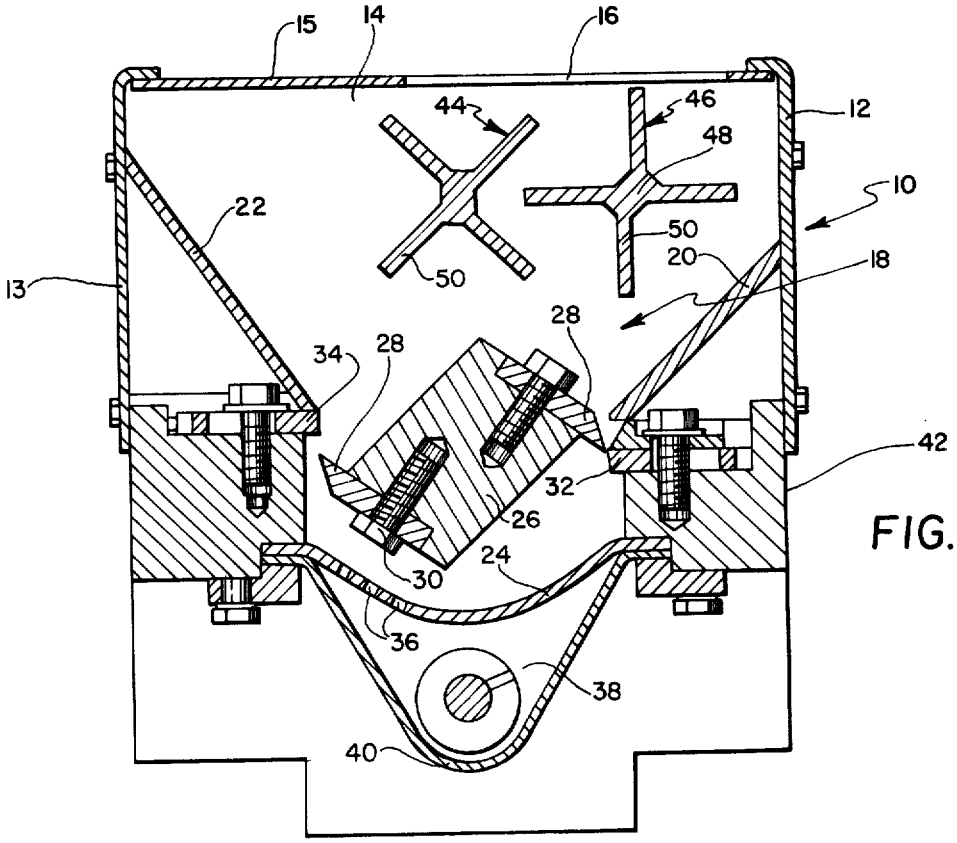
FIG. 3 is a partial sectional view taken along the line 3—3 of FIG. 1 and shows in particular the various constructional relationships of the granulator.

Turning now to the invention and more generally to FIGS. 1 and 3 thereof, the granulator 10 of the present invention includes upwardly extending front and rear walls 12 and 13 and end walls 14. A top wall 15 extends across such walls and defines an opening 16 by which materials such as plastic scrap are directed into a granulation chamber 18. This chamber is further defined by downwardly inwardly slanted chamber walls 20 and 22 disposed respectively on the downstroke and upstroke sides of the granulator and by a screen 24 disposed at the bottom thereof. A rotor 26 of any desired configuration and provided with cutting means in the form of a plurality of knives 28 suitably secured thereto as by bolts 30 is further included. The rotor 26 is journalled at opposite ends thereof for rotation within the chamber 18 such that scrap materials; i.e., plastic sprues and runners, enter the downstroke side of the chamber 18 and are granulated by the co-action of the rotor knives 28 with at least one and generally a pair of bed knives 32 and 34 respectively disposed on the downstroke and upstroke sides of the chamber.

Various adjustment mechanisms of known construction are utilized to adjust the cutting gap between the rotor knives 28 and the bed knives 32 and 34. The screen 24 is also provided with a plurality of openings 36 so as to regulate the dwell time of the partially granulated scrap within the chamber 18 and to insure the desired fineness thereof prior to leaving the chamber.

Positioned directly below the chamber 18 is a secondary or granulate chamber 38 formed by an elongated housing 40 suitably secured as is the screen 24 to the housing 42 of the granulator 10. In this regard, the word "housing" is used as a general term and includes overall supporting portions of the granulator 10 including but not limited to the front and rear walls 12 and 13, end walls 14, and the top wall 15.

The upper end of the chamber 18 is provided with a pair of laterally spaced, longitudinally directed, elongated paddle rolls 44 and 46, each having a central shaft 48 and a plurality of circumferentially spaced outwardly radiating blades 50 which are adapted to interdigitate in non-contacting relation with each other as the paddle rolls 44 and 46 are rotated towards each other in opposite rotational directions. The paddle rolls 44 and 46 are provided with shaft extensions 52 and 54 respectively at opposite ends thereof which extensions are suitably mounted for rotation in the granulator housing 42 either directly as by extension through side walls 14 or through attachment of a suitable reinforcing bracket 56 to such wall 14 as shown in FIG. 1.

The drive means 58 by which, the paddle rolls 44 and 46, are powered is mounted at said top or upper end of the granulator as viewed in the FIG. 1 representation thereof. Such drive means 58 includes a generally U-shaped frame formed by a pair of generally parallel plates 60 interconnected by a bottom or connecting plate 62 which cooperatively define an open interior space 64. Shaft extension 52 passes through the bracket 56 in which it is suitably journalled for rotational movement and extends outwardly thereof as is best shown in the FIG. 4 of the drawing. Mounted on such extending shaft portions of the paddle rolls is the drive means 58.

Figure 4:
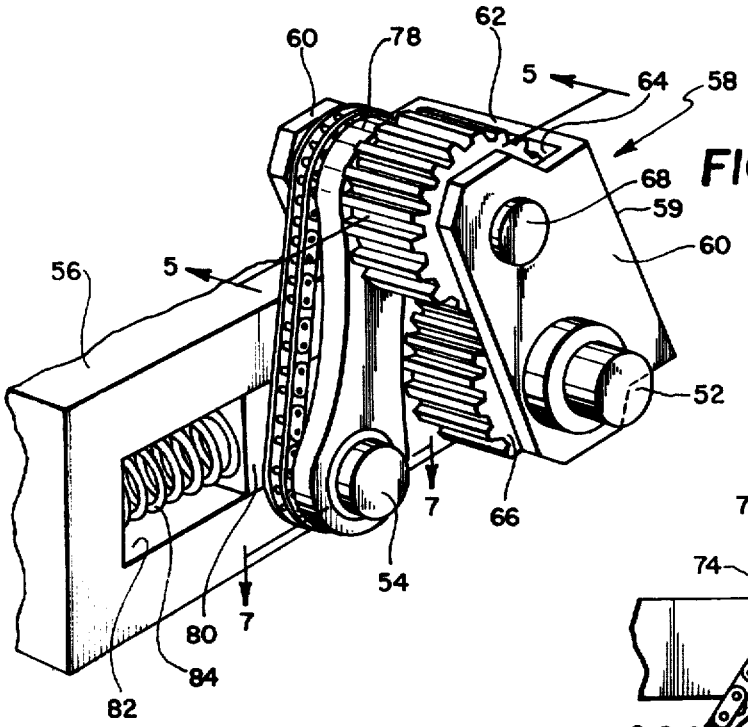
FIG. 4 is a perspective view of the drive means for the paddle roll feed assembly similar to its showing in FIG. 2.
Figure 5:
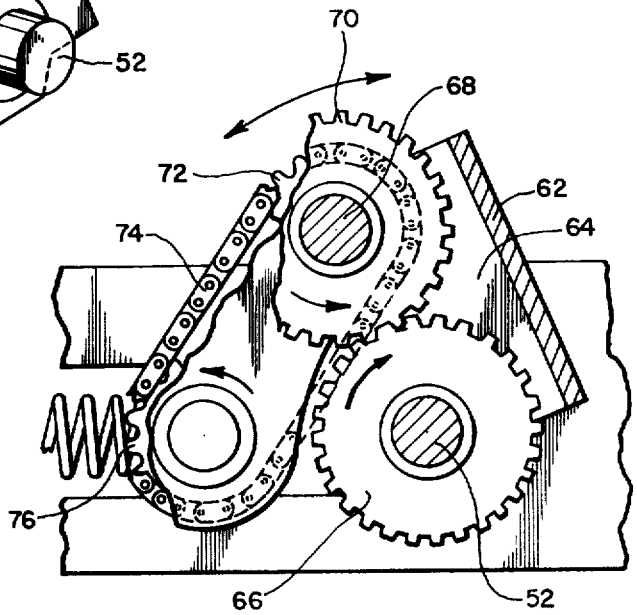
FIG. 5 is a sectional view with parts broken away for clarity taken along the line 5—5 of FIG. 4.

The shaft extension 52 extends through both of the spaced plates 60 in such a manner that the frame 59 thereof is able to freely rotate about or pivotally move with relationship to the shaft extension 52. From the above it may be seen that the shaft extension 52 is fixed in position relative to the housing 42 and such shaft and the first paddle roll 44 supported thereby are fixed for rotational movement with respect to the housing. Also as best shown in FIGS. 4 and 5, the shaft extension 52 includes a gear 66 fixed thereto and positioned within the interior space 64 of the frame 59. In addition, a connecting shaft 68 extends between these side plates 60 and is secured thereto for rotational movement. A first connecting shaft gear 70 is fixed to the connecting shaft 68 and adapted to mesh with the gear 66 of the first or fixed shaft extension 52. The connecting shaft 68 further includes a sprocket 72 longitudinally spaced from the first gear 70 thereof and over which a linked chain 74 is loosely trained to engage with a similar sprocket 76 fixedly attached to the second and movable shaft extension 54.

Between the connecting shaft gear 70 and sprocket 72, a connecting link 78 is pivotally supported thereby. The other end of the connecting link 78 rotatably receives an end of the movable shaft extension 54 which in turn passes through a bearing 80 laterally slidable within a slot 82 provided in the bracket 56. A spring 84 suitably under compression is positioned within the slot 82 and serves to engage the bearing 80 such that the bearing as well as the shaft 54 is continually urged towards the fixed shaft 52 to a predetermined position in spaced relation thereto by means of a positive stop 86. Other means other than the spring 84 to continually urge the movable shaft 54 towards the fixed shaft such as a piston and cylinder assembly (not shown) may be also utilized.

Figure 8:
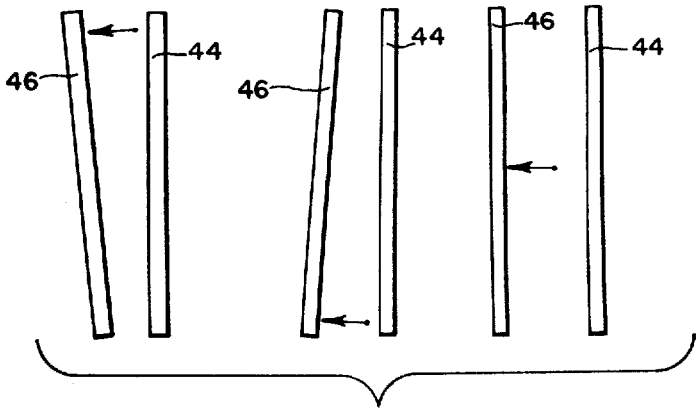
FIG. 8 is a diagrammatic illustration showing the various movement attitudes which the movable paddle roll may assume in relationship to the fixed position paddle roll.

The lower end of the granulator as viewed in FIG. 1 also includes a bracket 56 also provided with a slot 82 in which a similar bearing 80 mounted on that end of the shaft extension may provide for the aforementioned slidable motion at the opposite end of the shaft as well. In this manner, when larger than usual pieces of material are fed into the feed device, the movable roll 46 is free to assume the various relative positions vis-a-vis the fixed roll 44 as shown in FIG. 8 of the drawings. Also, as such movement is afforded by the slidable motion of the bearings 80 within the slots 82, the compression of the spring 84 after such material piece passes into the granulation chamber 18 returns the movable paddle roll 46 to its normal spaced position in relationship to the fixed paddle roll 44.

It should also be brought out that all during the accomplishment of such movement, the paddle rolls 44 and 46 are being rotated in a synchronous or articulated fashion and that such is brought about by driving the fixed shaft 52 by any suitable means and preferably from the opposite end of the granulator from which the drive means 58 is mounted as through a pulley 90 driven by a belt 92. Accordingly, rotary motion is transmitted to the shaft extension 52 which simultaneously causes the gear 66 to rotate so as to in turn cause gear 70 to rotate in the opposite direction at the same speed which speed is then imparted to the shaft 68 and then to the shaft 54 via the sprockets 72 and 76 mounted respectively on the connecting shaft 68 and the movable shaft extension 54. It should be brought out that the gears 66 and 70 should be generally of the same size and number of teeth and that the sprockets 72 and 76 should also be matched but not necessarily equal in size or configuration to the gear set formed by the gears 66 and 70. An essential feature is that a one to one final drive ratio be achieved between shafts 52 and 54.

Figure 2:
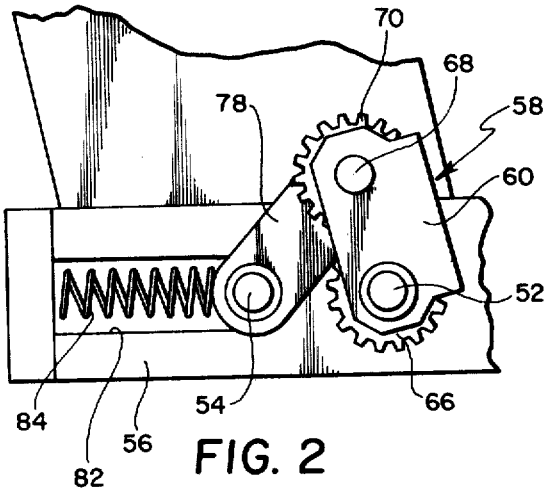
FIG. 2 is a partial side view thereof taken from the top portion of FIG. 1.
Figure 6:
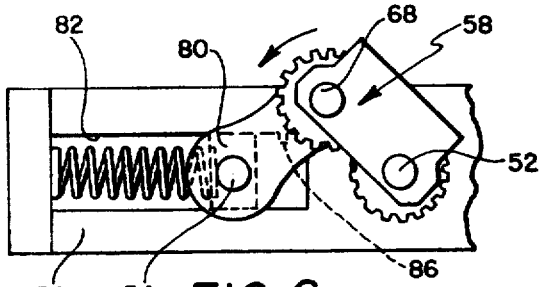
FIG. 6 is a view similar to FIG. 2 but showing the operational movement of the drive means to enable a lateral separating movement between the paddle rolls.

It should also be brought out that in assuming the various movement relationships as depicted in FIG. 8 that the link 78 is free to pivotally move about the connecting shaft 68 as is the frame 59 free to separately pivotally move about the connecting shaft 52. This above explained cooperative motion enables the distance between the shafts 52 and 68 to remain constant and the distance between the connecting shaft 68 and the shaft extension 54 to remain constant regardless of the various lateral spacing that may be assumed between the centers of the shafts 54 and 52. Such relationship may be easily seen by the transition between FIGS. 2 and 6 wherein the shafts 54 and 52 are closely associated in spaced relationship in FIG. 2 and FIG. 6 where the shafts 54 and 52 are spaced further apart.

Figure 7:
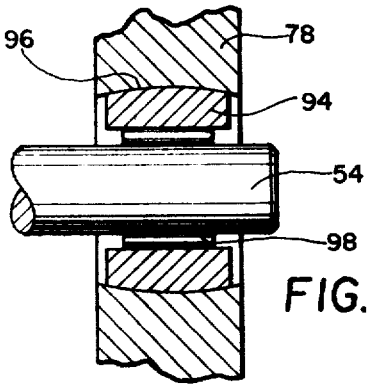
FIG. 7 is a sectional view on an enlarged scale taken through the lines 7—7 of FIG. 4 and shows in particular the bearing mount for the end of the shaft on which one of the paddle rolls is mounted.

Also, and as best seen by reference to FIG. 7, the bearing in which the shaft 54 is supported by the link 78, enables at least a limited amount of spherical motion to be imparted to the shaft 54. To provide this action, the outer race 94 thereof is partially spherically shaped and may accordingly move within a similarly shaped socket 96 such that the movable shaft 54 may assume a skewed relationship to the affixed shaft 52 more easily. For this same reason, it is also preferable that the chain 74 be somewhat flexible and trained over the sprockets 72 and 76 such that the twisting thereof as may be brought about by such skewed positioning of the movable shaft 54 will not be retarded by the chain. It is also desirable to use a side-bow chain which exhibits extra pin and side plate clearance so that it can twist sideways. In this regard, it has been found that a moderately slack chain so as to permit a plus or minus 5 degrees skew of one shaft to the other still enables effective transmission of force in the desired manner without any loss of synchronous movement between the various gears and sprockets in the drive system 58.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a device for size reduction of material such as plastic scrap from an injection molding machine, said device having a housing in part defining a generally enclosed chamber, an elongated rotor mounted for rotation about an elongated axis within said chamber, cutting means provided on said rotor for cooperative cutting relationship with bed knife means mounted for projection into said chamber as said rotor is driven, elongated feed means positioned above and generally aligned with said rotor and at least partially enclosing said chamber at an upper end thereof and removable means positioned below said chamber for removing granulated scrap from said granulator, said feed means including a pair of elongated paddle rolls each having spaced blades radially extending from a central shaft, said blades adapted to interdigitate with each other as said shafts rotate in opposite directions towards each other so as to feed material into said chamber, said shafts supported by said housing and normally disposed parallel to each other within a generally laterally disposed plane disposed above said rotor with a first of said shafts fixed in position relative to said housing and the second shaft slidably supported in said housing for movement of any portion of said second shaft towards and away from said first shaft within said lateral plane so as to accomplish increased spacing between said paddle rolls at any location therealong including locations which will skew said second shaft with respect to said first shaft so as to afford the passage of oversized material therebetween, the improvement comprising drive means for driving said shafts in rotational synchronism at all times despite the relative lateral movement which may take place between said shaft, said drive means having a frame pivotally supported on one end of said first shaft, said frame further supporting a pivotal link at one end thereof and to which said shaft is connected at the other end thereof, means extending between said shafts and said frame for transmitting rotary motion to said second shaft as said first shaft is rotated.

2. The device of claim 1, said housing including longitudinally spaced end walls each of which is provided with a laterally extending slot, said shafts supported at opposite ends thereof by said end walls with said second shaft freely slidable within said slot, means in said slot for continually urging said second shaft towards said first shaft.

3. The device of claim 2, said second shaft ends having a bearing mounted thereon, said bearings in turn adapted for slidable movement in said slots from a first positive stop position proximate said first shaft to a second position laterally removed therefrom.

4. The device of claim 2, said means for continually urging said second shaft towards said first shaft being a partially compressed spring mounted in each of said slots.

5. The device of claim 1, said frame including a pair of longitudinally spaced rigidly interconnected side plates through which said first shaft extends, a countershaft supported between said plates and on which said pivotal link is supported, a gear fixedly connected to each of said first shaft and connecting shaft and a sprocket connected to said second shaft, and motion transmitting means interconnecting said first shaft gear with said second shaft sprocket.

6. The device of claim 5, said first and connecting shaft gears intermeshed, a connecting shaft sprocket rigidly fixed to said connecting shaft and a chain interconnecting said connecting shaft sprocket with said second shaft sprocket.

7. The device of claim 1, said frame being generally U-shaped and including a bottom plate connecting said side plates together.

8. The device of claim 1, said second shaft journalled in said link other end by means of a bearing which permits at least limited spherical movement of said second shaft with respect thereto.

* * * * *